United States Patent [19]

Brooks et al.

[11] Patent Number: 4,960,336

[45] Date of Patent: Oct. 2, 1990

[54] APPARATUS AND METHOD FOR CALIBRATING PRINTING AT A SPECIFIED DISTANCE FROM A DOCUMENT EDGE

[75] Inventors: Ralf M. Brooks, Waterloo; Fredrik L. N. Kallin, Kitchener; Gary R. Marshall, Alma; Bruce A. Reid, Elmira, all of Canada

[73] Assignee: NCR Corporation, Dayton, Ohio

[21] Appl. No.: 470,452

[22] Filed: Jan. 26, 1990

[51] Int. Cl.[5] ..... B41J 5/30; B41J 3/20

[52] U.S. Cl. ..... 400/61; 400/62; 400/120; 400/583; 400/103; 346/76 PH; 364/519; 235/432

[58] Field of Search ..... 400/61-64, 400/120, 583, 583.3, 103; 346/76 PH; 364/519; 235/432

[56] References Cited

U.S. PATENT DOCUMENTS

| | | | |
|---|---|---|---|
| 4,311,399 | 1/1982 | Wegryn et al. | 400/64 |
| 4,394,092 | 7/1983 | Osmera et al. | 400/120 |
| 4,555,617 | 11/1985 | Brooks et al. | 235/379 |
| 4,573,058 | 2/1986 | Brooks | 346/76 PH |
| 4,595,935 | 6/1986 | Brooks et al. | 346/76 PH |
| 4,625,216 | 11/1986 | Brooks et al. | 346/76 PH |
| 4,661,001 | 4/1987 | Takai et al. | 400/120 |
| 4,731,524 | 3/1988 | Brooks | 235/432 |
| 4,758,966 | 7/1988 | Brooks et al. | 364/519 |
| 4,778,288 | 10/1988 | Nakamura | 400/61 |
| 4,783,667 | 11/1988 | Brooks | 346/76 PH |
| 4,812,999 | 3/1989 | O'hara | 364/519 |
| 4,818,126 | 4/1989 | Brooks et al. | 400/120 |
| 4,827,286 | 5/1989 | Sukigar et al. | 346/76 PH |
| 4,861,175 | 8/1989 | Hori et al. | 400/61 |

*Primary Examiner*—Eugene H. Eickholt

*Attorney, Agent, or Firm*—Wilbert Hawk, Jr.; Albert L. Sessler, Jr.; Elmer Wargo

[57] ABSTRACT

A method for calibrating a printer to print data beginning at a specified distance from the reference edge of a document. Several test documents are moved through a print station and a test symbol is printed on each of them with a preselected set of heating elements from a dot matrix thermal printer. The test documents are then processed through the same print station whereupon a sensor detects the reference edge of the document and the test symbol. A master controller then determines a test symbol distance between the reference edge and the midpoint of the test symbol for each test document. A plurality of test documents is processed in this manner, and the master controller determines an average test symbol distance for the plurality of test documents. Using an average test symbol distance, the master controller determines the distance between the sensor and a given hewating element of the thermal printer. The master controller than calculates a calibration distance which is based on a comparison of actual distance between the reference edge and the preselected heating elements versus average test symbol distance. In order to calibrate the printer to account for the calibration distance so that the printer prints data beginning at substantially the specified distance from the reference edge of the document, the master controller utilizes a stepping motor to make coarse calibration adjustments by advancing the document in full and/or half steps. Fine calibration adjustments are made by selectively energizing heating elements of the thermal printer.

21 Claims, 10 Drawing Sheets

APPARATUS AND METHOD FOR CALIBRATING PRINTING AT A SPECIFIED DISTANCE FROM A DOCUMENT EDGE

BACKGROUND OF THE INVENTION

1. Field of the Invention

This invention relates generally to a document printer. In particular, the invention relates to an apparatus and method for calibrating a printer to print data at a specified distance from a reference edge of a document moving through a print station.

2. Description of Related Art

Printing apparatuses have been developed for many uses, including the printing of various information in various type fonts, such as E13B, OCRA and OCRB, on paper checks, for example. In most instances, it is desired or even required that the data be printed at a specific location or area on the check. For example, the American National Standards Institute (ANSI) has established standards that require a specified distance be maintained between a reference edge of the check and the first data character printed thereon. A typical example is the printing of MICR data in E13B font for which the ANSI specification requires the leading edge of the first character to be located in a character field beginning at 5/16 inch ±1/16 inch from the reference edge of the check. In printers of the past, the print station would have to be manually calibrated to print data in the desired character field on the check. The check would be positioned at the print station and data or a test symbol would be printed thereon. A manufacturing or repair person (hereinafter field engineer) would usually observe where the data was actually being printed on the check and would then manually adjust or calibrate the print station so that the leading edge of the first character of data was printed beginning at the desired location. This process is time consuming, expensive, and leads to inaccurate results due to human error.

SUMMARY OF THE INVENTION

There is, therefore, a present need to provide a method for calibrating a printer which is inexpensive, which can easily be performed, and which is not time consuming.

In one aspect of the invention, there is provided a method for calibrating a printer at a print station to print data in a character field beginning at a specified distance from the reference edge of a document moving through the print station; said method comprising the steps of: (a) positioning a test document at the print station, (b) printing a test symbol on the test document with a print member having a plurality of heating elements, said test symbol having a midpoint which is printed by a preselected heating element, (c) sensing the test symbol distance between the reference edge and the midpoint of the test symbol with a sensor, (d) repeating step (a) through step (c) at least one time, (e) calculating an average test symbol distance by averaging the test symbol distances determined in steps (c) and (d), (f) determining the actual distance between the preselected heating element and the reference edge, (g) determining the relative location between the sensor and each the heating element of the print member, (h) determining a calibration distance which is the difference between the actual distance determined in step (f) and the average test symbol distance, and (i) calibrating the printer to account for the calibration distance so that the leading edge of the first character of data to be printed is printed on each document at the specified distance from the reference edge of the document when the document is moved through the print station.

In another aspect of the invention there is provided a printer for printing data starting at a specified distance from a reference edge of a document, said printer comprising: a print station, a track for feeding a document to the print station, a print member located at the print station, drive means for moving a document towards and away from the print station, said print member including a plurality of heating elements located at the print station, said print member being capable of printing data including a test symbol on the document, sensing means for sensing the reference edge of the document, and control means for controlling the printer, said print member, said drive means, and said sensing means, said control means being effective to: energize preselected ones of the plurality of heating elements to print the test symbol on the document, the test symbol having a midpoint being printed with a preselected heating element, energize the sensing means to sense an actual distance between the reference edge and the midpoint of the test symbol to provide a test symbol distance, determine an average test symbol distance based upon the test symbol distances sensed for a plurality of the documents, calculate a distance between the reference edge and the preselected heating element to provide a midpoint heating element distance, use the midpoint heating element distance to determine the relative location of each heating element relative to the sensor, calculate the difference between the midpoint heating element distance and the average test symbol distance to provide a calibration distance, adjust the calibration distance to account for the specified distance, and calibrate the printer to account for the calibration distance, the control means energizing the drive means and selectively energizing the heating elements in order to calibrate the printer to adjust for the calibration distance so that the printer will print data beginning at the specified distance from the reference edge of any the document moving through the printer.

The primary object of this invention is to provide a printer which may be electronically calibrated, thereby eliminating the need to have a field engineer manually adjust the location of the printing means relative to the sensing means.

Another object of this invention is to provide a method for calibrating a printer to conform to various printing standards.

A further object of this invention is to provide a method for calibrating a printer which makes it easy to utilize, for example, with elements of a thermal printer selected to print the characters.

Another object of this invention is to provide a printer which is easy and quick to calibrate to print data at a specified distance from the reference edge of the document.

Still another object of this invention is to provide a means for calibrating a printer that is relatively easy and inexpensive to implement.

Yet another object of this invention is to provide a method of calibration that will enable a user to selectively utilize different heating elements of a thermal printer so as to fine tune the printing of the leading edge of the first character of data in the character field.

These objects and others will become more apparent from the following specification, claims, and drawing.

BRIEF DESCRIPTION OF THE DRAWING

FIGS. 4 and 5, is an enlarged view of the test symbol shown in FIG. 5, showing the matrix of dots which form the test symbol;

DESCRIPTION OF THE PREFERRED EMBODIMENT

Figure 1:
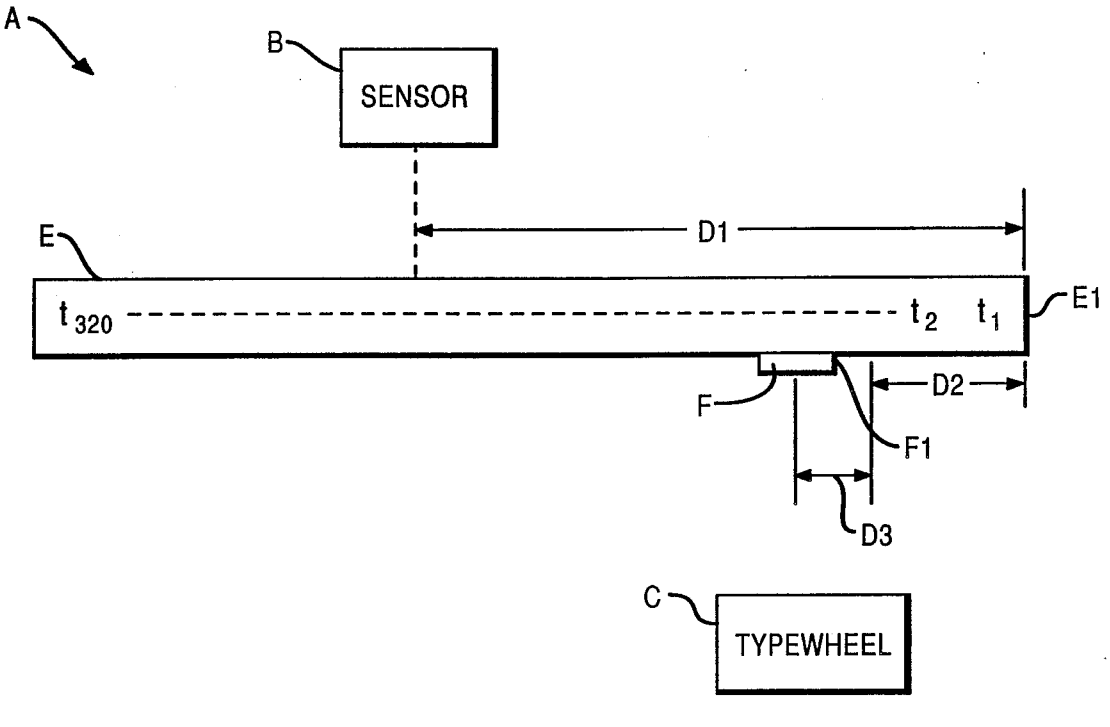
PRIOR ART FIG. 1
FIG. 1 is a top view of a prior art print station.

Before discussing a preferred embodiment of this invention, a brief explanation of a prior art method of calibrating a printer will now be described. FIG. 1 shows a top view of a prior art print station A of a printer. The print station A includes a sensor B located opposite a thermal printer C. A document E having a reference edge El is located at the print station A between the sensor B and the thermal printer C. As illustrated, the thermal printer C has print elements t1 through t320. A distance D2 represents a preferred distance from the reference edge El in which it is desired to begin printing a first character of data (not shown). In the prior art printers, a field engineer would cause a document E to be moved past the sensor B a known distance D1. A character F would be printed on the document E using, for example, an impact typewheel C and an opposing hammer (not shown). The field engineer would remove the document E from the print station A and visually observe the distance between the reference edge El and the leading edge Fl of the character F. Such engineer would usually compare the location of the leading edge Fl of the character F to a desired location from the reference edge E1, indicated by the distance D2. The field engineer would then calibrate the printer to account for the distance D3 by manually altering the relative position between sensor B and the typewheel C so that, when another document E is moved the distance D1 past the sensor B and the typewheel is energized to print the first character of data, the leading edge of the character would be printed beginning at the distance D2.

Figure 2:
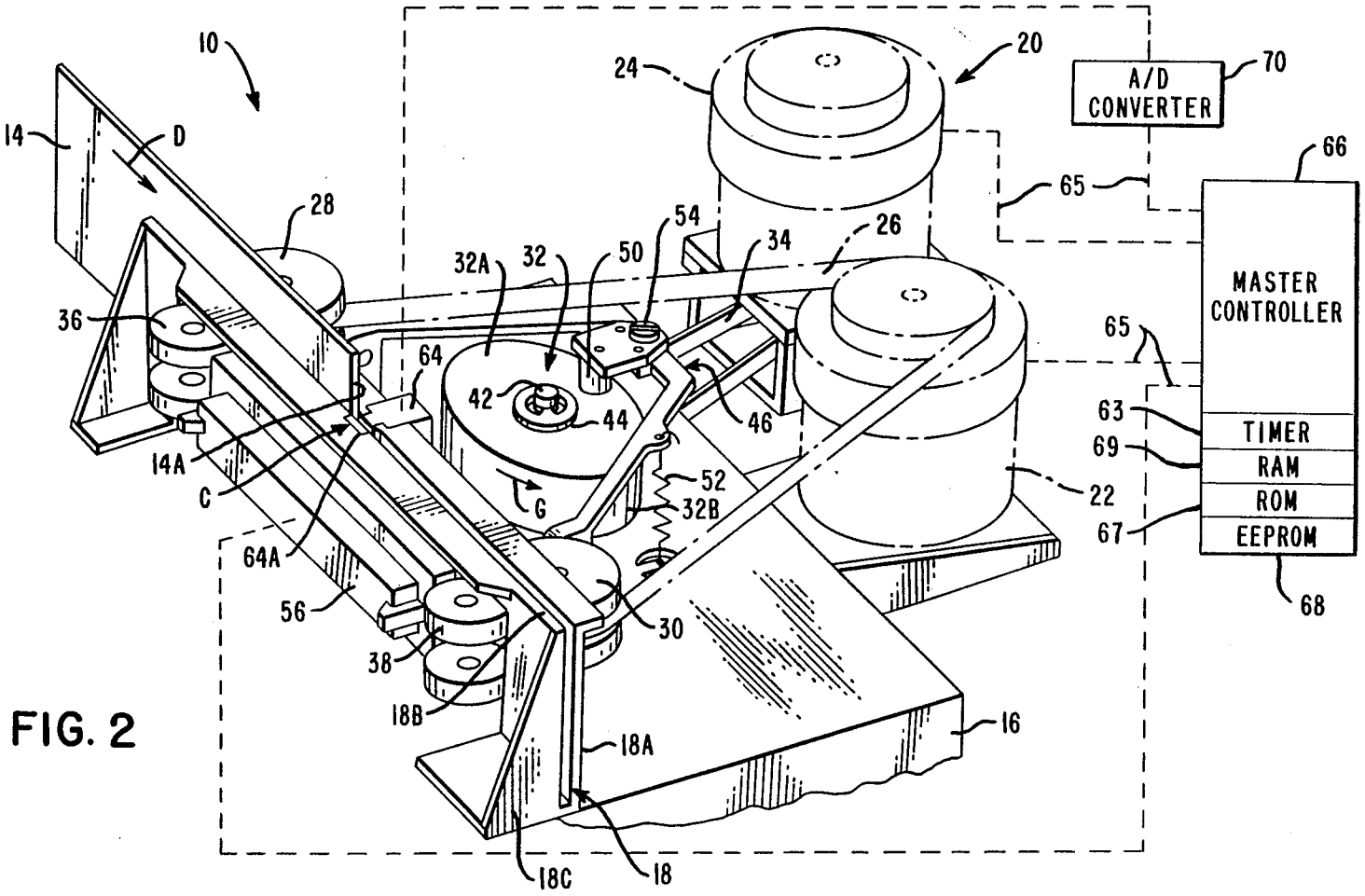
FIG. 2 is a perspective view of a printer in which a preferred embodiment of this invention may be used.
Figure 4:
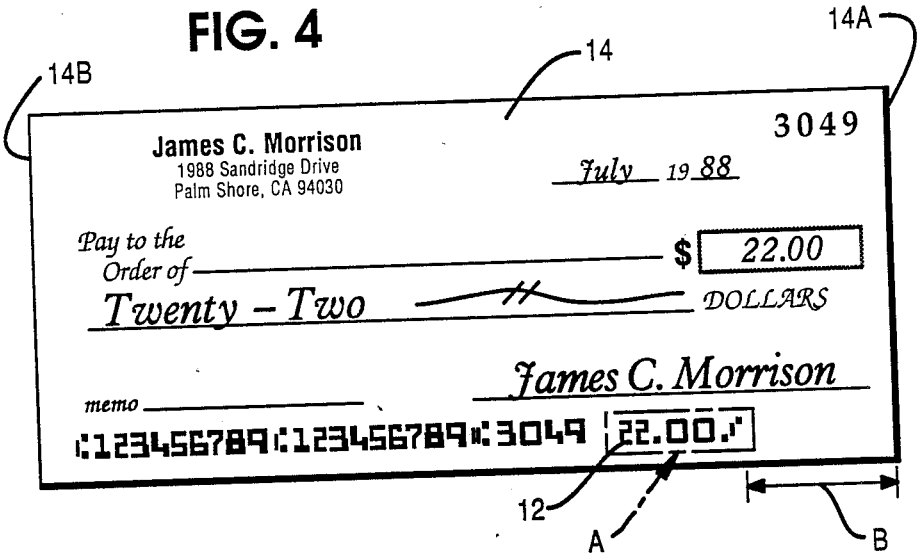
FIG. 4 is a front view of a document, showing data which may be printed on the document and also showing a preselected area which begins at a specified distance from a reference edge of the document.
Figure 5:
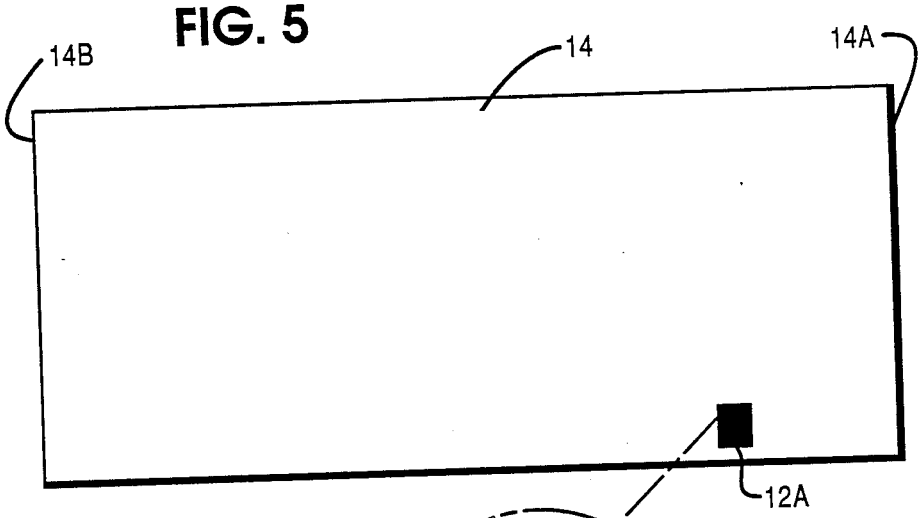
FIG. 5 is a front view of a test document, showing a test symbol printed at substantially the specified distance from the reference edge of the document.

FIG. 2 is a perspective view of a preferred thermal printer, hereinafter designated generally as printer 10, in which a preferred embodiment of this invention may be used. The function of printer 10 is to print monetary amounts or other data 12 (FIG. 4) on a document 14. It is to be noted that the document 14 can be any suitable commercial document, like a check. As best shown in FIG. 5, the document 14 could be a test document which is generally the same size and shape as the check, for example, except that it is blank. A function of printer 10 is to print data 12 in a preselected area, indicated by arrow A in FIG. 4, on the test document 14. The printer 10 can also print a test symbol 12A (FIG. 5) which is used during the calibration of printer 10. It is to be noted that the preselected area A begins at a specified distance, indicated by arrow B in FIG. 4, from reference edge 14A.

Figure 8:
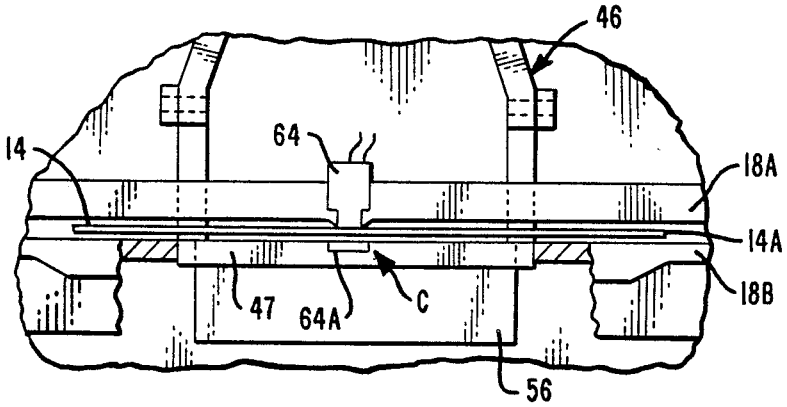
FIG. 8, which is shown on the same sheet as FIG. 6, is a fragmentary top view of a portion of the printer shown in FIG. 2, showing the document in the document track at a print station.

The printer 10 (FIG. 2) comprises a base 16 which is a casting made of aluminum. The printer 10 also includes a document track 18 in which document 14 may travel to a print station, designated generally by arrow C in FIGS. 2, 6, and 8. The track 18 has first and second track walls 18A and 18B, respectively. The track 18 has a generally "L"-shaped flange 18C which is secured to base 16 by suitable fasteners (not shown).

The printer 10 (FIG. 2) also includes a drive means 20 for controlling the movement of document 14 in track 18 and for moving the document 14 to the print station C. The drive means 20 includes a document stepping motor 22, printer cam drive motor 24, first and second drive rollers 28 and 30, and first and second pinch rollers 36 and 38, a dual surface cam 32, and a timing belt 34. The document stepping motor 22 and printer cam drive motor 24 are capable of making full steps of 0.050 and 0.001625 inch, respectively, and the document stepping motor 22 is capable of making half steps of 0.025 inch. The document stepping motor 22 is operatively coupled to the first and second drive rollers 28 and 30, respectively, by timing belt 26. The first and second drive rollers 28 and 30 are conventionally mounted in operative relationship with track wall 18A of document track 18. The first and second pinch rollers 36 and 38 are conventionally mounted in operative relationship with track wall 18B and opposite the first and second drive rollers 28 and 30, respectively. The first and second pinch rollers 36 and 38 engage and coact with drive rollers 28 and 30, respectively, to control the movement of document 14 in track 18.

Figure 3:
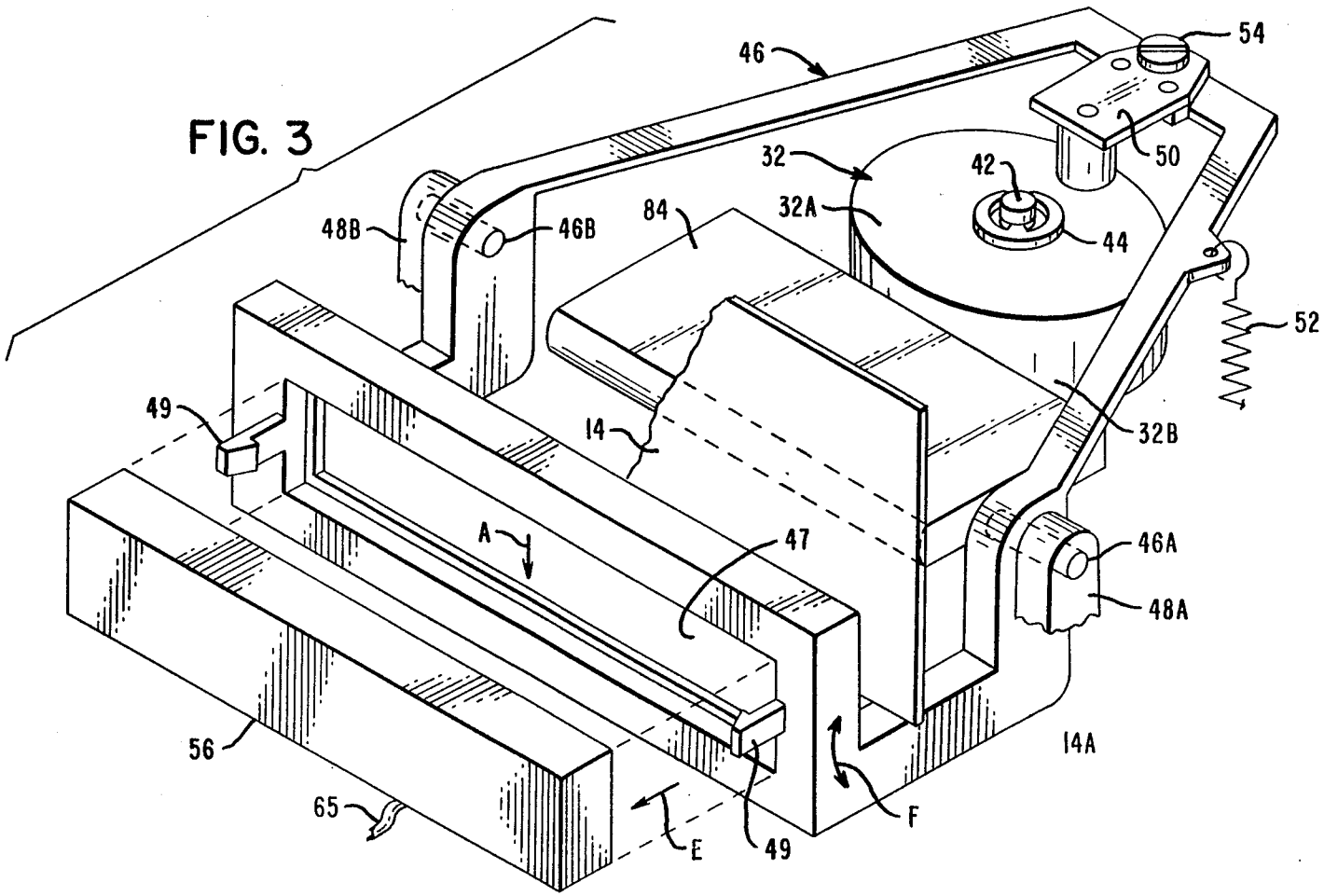
FIG. 3 is a perspective view showing a double cam, pivot arm, and print member which are part of the printer shown in FIG. 2.

The printer cam drive motor 24 is operatively coupled to the dual surface cam 32 by timing belt 34. The dual surface cam 32 has a crown surface 32A and a radial surface 32B, and the dual surface cam 32 is mounted on axle 42 and is secured thereto by C-clip 44. In a preferred embodiment, axle 42 is cast as part of base 16. As best shown in FIGS. 2 and 3, a pivot arm 46 includes a cam follower member 50 which is secured to the pivot arm 46 by a screw 54. The cam follower member 50 follows the crown surface 32A of dual surface cam 32 and causes the pivot arm 46 to pivot about pivot members 46A and 46B in an arc indicated by the arcuately-shaped double arrow F in FIG. 3. As described later herein, the radial surface 32B of dual surface cam 32 engages a platen 84 which forces the document 14 against a print member 56. The pivot arm 46 has pivot members 46*a* and 46*b* which are pivotally mounted in mounting supports 48*a* and 48*b*, respectively, of base 16. In a preferred embodiment, spring 52 (FIG. 2) is secured between pivot arm 46 and base 16 for biasing cam follower member 50 against the crown surface 32A of dual surface cam 32. For an understanding of the operation of dual surface cam 32, the reader is referred to U.S. Pat. No. 4,818,126 which is assigned to the same assignee as the present invention and which is also incorporated herein by reference.

Figure 6:
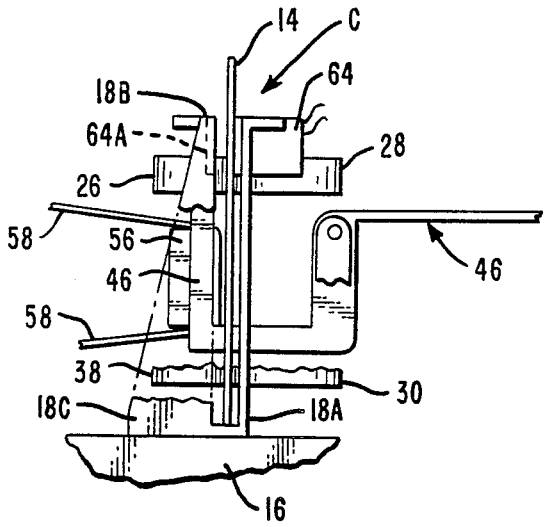
FIG. 6 is a fragmentary side view of the invention, showing an end of the document track shown in FIG. 2 with a document therein and also showing a print ribbon.
Figure 7:
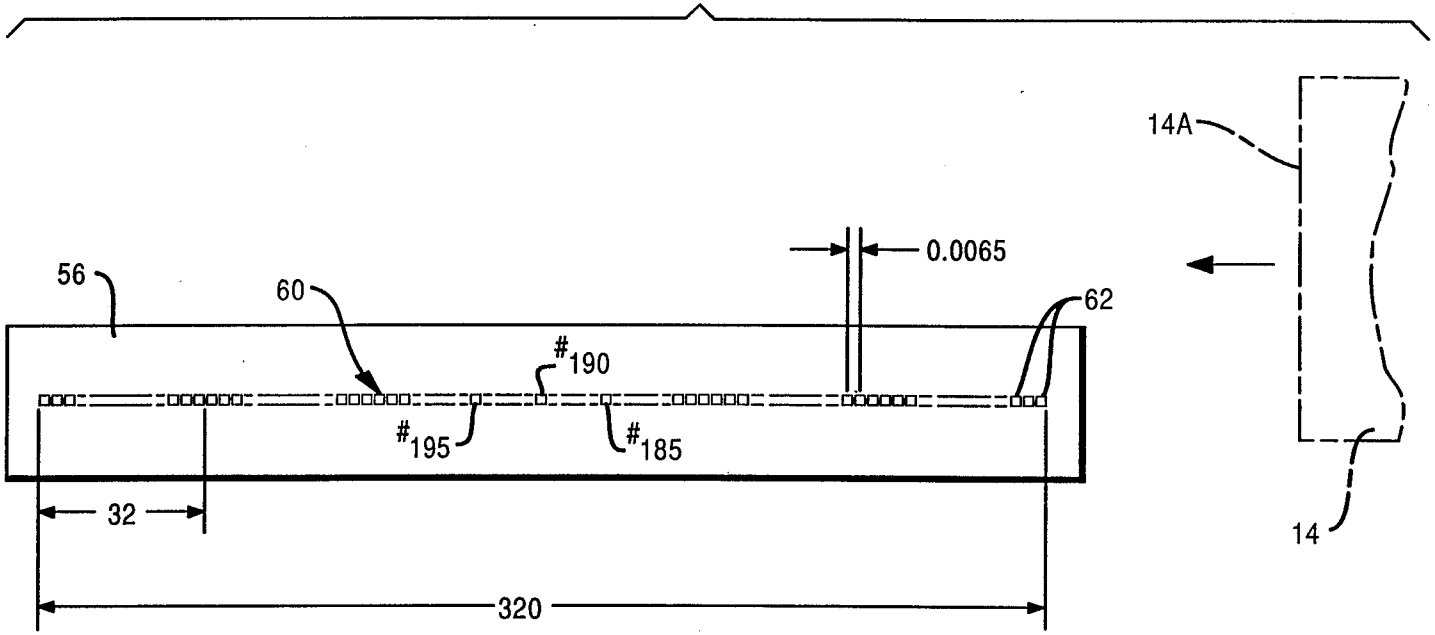
FIG. 7 is a front view of a thermal print member included in the printer shown in FIG. 1, when looking in the direction of arrow E in FIG. 3, showing a row of heating elements of the print member and also showing the leading edge of the document and the direction of movement of the document.

The print member 56 (FIG. 3) is mounted in the pivot arm 46 and is secured thereto by two resilient detents 49. A thermal transfer print ribbon 58 (FIG. 6) lies between the print member 56 and document 14, as best shown in FIG. 6. It is to be noted that when it is desired to print data 12 on document 14, the radial surface 32B of dual surface cam 32 forces a platen 84 (shown diagrammatically in FIG. 3) against document 14 which is forced against thermal transfer print ribbon 58 and print member 56 whereupon print member 56 is energized to print data 12 on document 14. The platen 84 is arcuately shaped to enable it to maintain constant pressure against the print member 56 as the print member 56 is pivoted along a prescribed arc. In a preferred embodiment, the print member 56 is a one row printhead model TX-C6A8-001E, manufactured by Matsushita Corporation of Japan. The print member 56 (FIG. 7) is comprised of a single line 60 of 320 heating elements 62. In a preferred embodiment, each heating element 62 is generally rectangular and has a width of approximately 0.00550 inch and a height of approximately 0.0078 inch. As shown in FIG. 7, each heating element 62 has a pitch of 0.00650 inch. Each heating element 62 can be individually and selectively energized by a master controller 66 (FIG. 2).

Figure 9:
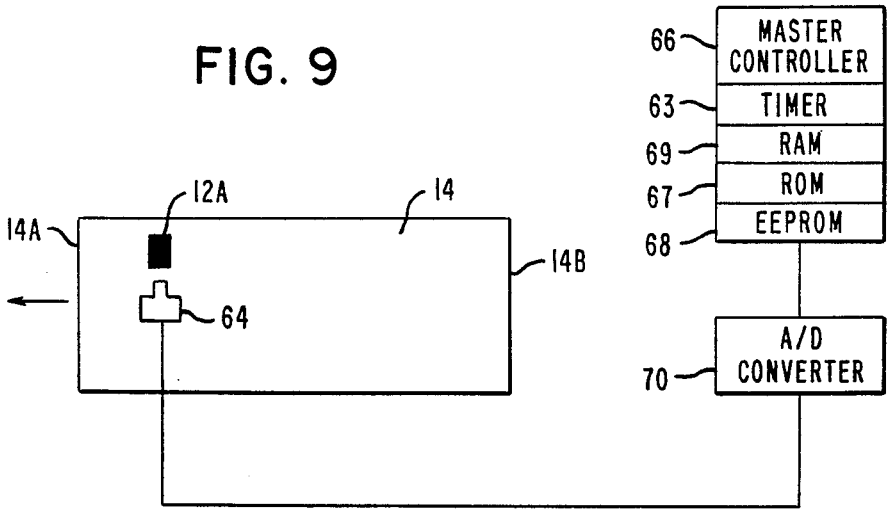
FIG. 9 is a front view of the document with the test symbol printed thereon.
Figure 9A:
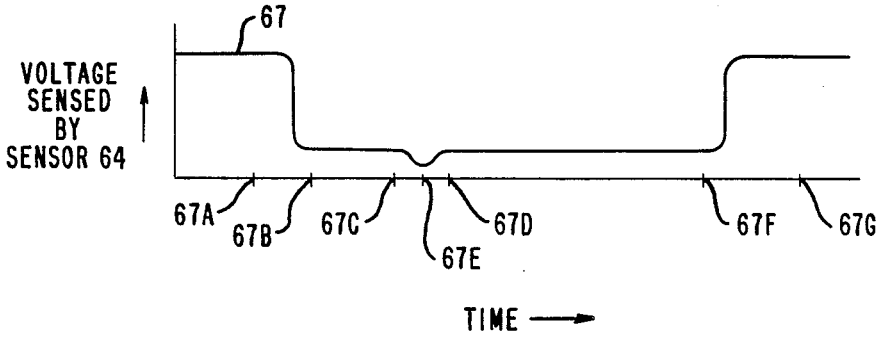
FIG. 9A is a general voltage waveform corresponding to the document and the test symbol shown in FIG. 9.

The printer 10 (FIG. 2) also includes a means for optically sensing, for example, the reference edge 14A of document 14 and the test symbol 12A. The means for sensing includes a reflective sensor 64 which is mounted directly on track wall 18A of track 18 and is mounted opposite to the print member 56. In a preferred embodiment, the sensor 64 has a narrow beam angle for accurate detection of the reference edge 14A. The sensor 64 is also positioned near the center of the print member 56 so that the document 14 will traverse a majority of heating elements 62 when the document 14 is stopped at the print station C. As will be described later herein, during the calibration process, the test symbol 12A is printed on the test document 14 by print member 56, and the document 14 is inverted and placed in the track 18 so that the test symbol 12A faces the sensor 64. The height of the test document 14 is chosen so that the sensor 64 is properly aligned with the midpoint of test symbol 12A printed on document 14. In a preferred embodiment, the sensor 64 is a conventional optical reflective sensor having an associated mirror 64*a* (FIG. 8), and the sensor 64 generates a voltage signal proportional to the light reflection it senses. FIGS. 2 and 9 show an analog to digital converter or A/D converter 70 operatively coupled between sensor 64 and a master controller 66. In the embodiment being described, the master controller 66 is a model 8032 controller, manufactured by Intel Corporation. The master controller 66 can be programmed and loaded with software to perform the functions described hereinafter. The analog output from sensor 64 is inputted to the A/D converter 70 which transmits a corresponding binary signal to the master controller 66. FIG. 9A shows a typical voltage waveform 67 for a typical test document 14 as it passes the sensor 64. Waveform 67 changes from a high voltage level at time 67A to a low voltage level at time 67B when the sensor 64 is unblocked and blocked, respectively, by document 14. The sensor 64 also senses the range of voltage levels at times 67C–67D which represent the test symbol 12A, and master controller 66 determines the midpoint which occurs approximately at time 67E. Sensor 64 also senses the trailing edge 14B of document 14 which is represented by the voltage going from a low voltage at time 67F to a high voltage at time 67G.

Finally, printer 10 includes a means for controlling or master controller for controlling the operation of the printer 10. The master controller 66 (FIGS. 2 and 9) is operatively coupled to document stepping motor 22, printer cam drive motor 24, print member 56, sensor 64, and A/D converter 70 by suitable conductors 65 (FIG. 2). The master controller 66 includes read-only memory (ROM) 67, a random-access memory (RAM) 69, and a nonvolatile electronically erasable programmable read only memory (EEPROM) 68. The EEPROM 68 stores conventional software which controls the operation of printer 10 and which enables the printer 10 to print data 12, including test symbol 12A, on document 14 and which also enables the field engineer to calibrate the printer 10. The EEPROM 68 can also be programmed to store information, such as, for example, data corresponding to the preselected area A (FIG. 4) and the specified distance B. The ROM 67 or RAM 69 can be used, for example, to store the location of a given heating element 62 relative to the position of the sensor 64 of print member 56.

Figure 10:
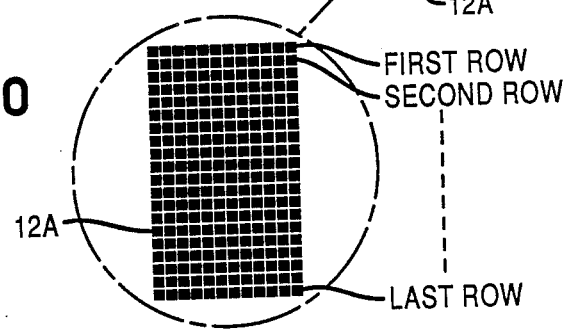
FIG. 10, which is shown on the sheet containing

The printing of a test symbol 12A on a document 14 will now be illustrated in relation to FIGS. 5 and 10. The master controller 66 energizes print drive motor 22 to move cam 32 in the direction of arrow G in FIG. 2 so that the crown surface 32A of cam 32 engages cam follower member 50, thereby positioning the print member 56 towards the top of the document 14 located at the print station C. The heating elements 62 of print member 56 print a first row of dots at a time towards the bottom of document 14. This row forms the width of the test symbol 12A. The master controller 66 then energizes the printer cam drive motor 24 which causes the dual surface cam 32 to rotate in the direction of arrow G in FIG. 2. The rotation of the crown surface 32A of dual surface cam 32 causes the pivot arm 46 to pivot vertically upward in an arc which in turn causes print member 56 to pivot downward in the opposite direction. The master controller 66 then energizes the heating elements 62 to print a second row of dots on document 14. This process continues until the last row of dots is printed on the document 14, thereby forming the height of the test symbol 12A. This matrix of rows and columns of dots forms the test symbol, as can best be seen in relation to FIG. 10.

Before describing in detail the operation of a preferred embodiment of this invention, an overview of the invention may be useful. It is not uncommon to find that the sensor 64 in the printer 10 is mounted in an unknown relationship relative to the heating elements 62 of the print member 56. Under ideal circumstances, it would be desirable to mount the sensor 64 an exact distance from, for example, the middle heating element 62 of print member 56. However, this is not practical to do because of, for example, manufacturing tolerances in assembling the printer 10. Consequently, there will be an unknown distance, hereafter referred to as the calibrating distance, between the sensor 64 and a preselected heating element 62 on the print member 54. In order to avoid having to manually adjust the relative position of the sensor 64 and print member 56 in the printer 10 to make the calibration distance equal to the specified distance B, the present invention permits the distance between sensor 64 and a known heating element 62 to be determined. Using this distance information, the distance between the sensor 64 and every other heating element 62 is determined by the master controller 66. This is effected by printing the test symbol 12A on the test document 14 with certain known heating elements 62, as will be described later herein. In general, the distance between the reference edge 14A and the midpoint of the test symbol 12A is then determined by using the sensor 64. Because the reference edge 14A is located at the sensor 64 when the test symbol 12A is printed on the document 14, the master controller 66 can determine the distance between the sensor 64 and the preselected heating elements 62 used to print the test symbol 12A. The master controller 66 then determines the distance between the sensor 64 and every other heat element 62 on the print member 56 because the heat elements 62 are located a precise pitch distance apart. Once these distances are known, the master controller 66 stores the information in ROM 67 or RAM 69. As will be described later herein, the master controller 66 uses this information, as well as information regarding the location of the reference edge 14A, to make coarse and/or fine calibration adjustments so that the leading edge of the first character of data 12 is printed at precisely the preselected area A beginning at the specified distance B from the reference edge 14A. The master controller makes coarse calibration adjustments by energizing the document stepping motor 22 to cause the document 14 to stop either early or late at the print station C, and it makes fine calibration adjustments by selectively energizing individual heating elements 62 of print member 56. Thus, the master controller 66 can effect the calibration of the printer 10 to adjust for the calibration distance without having to manually adjust the physical relationship or location of the sensor 64 or print member 56.

The method of operation of a preferred embodiment of this invention will now be described in greater detail in relation to FIG. 13. A first step, indicated by block 86, is to position a test document 14 (FIG. 5) in document track 18 (FIG. 2) when it is desired to calibrate printer 10. The master controller 66 energizes document stepping motor 22 to move the test document 14 at a first predetermined rate of speed towards the print station C (FIGS. 2, 6, and 8) in the direction of arrow D in FIG. 2. The sensor 64 senses the reference edge 14A of test document 14 at which time master controller 66 causes document stepping motor 22 to stop the document 14. The master controller 66 then energizes the document stepping motor 22 to reverse the direction of movement of document 14. In a preferred embodiment, the document 14 is moved in a reverse direction away from sensor 64 until the reference edge 14A is approximately 3 millimeters upstream from the sensor 64. The master controller 66 then causes document stepping motor 22 to advance document 14 forward at a second predetermined rate of speed which is slower than the first predetermined rate of speed until the reference edge 14A is again sensed at print station C, whereupon master controller 66 causes document stepping motor 22 to stop document 14. A typical first predetermined rate of speed is 0.050 inch step per 3 milliseconds. In a preferred embodiment, the first and second rates of speed are accomplished by the document stepping motor 22 advancing the document 14 in full and/or half steps, respectively. This process of advancing the document 14 forward at the second slower predetermined rate of speed permits the master controller 66 to get a more accurate alignment of reference edge 14A of document 14 and the sensor 64.

After document 14 is positioned in this manner, another step (block 88 in FIG. 13) includes printing the test symbol 12A on document 14 with a preselected set of heating elements 62 (FIG. 7). By way of illustration, heating elements #185 to #195 may be preselected to print a row or line of dots (FIG. 10) on document 14 to form the width of the test symbol 12A, as described above. The print member 56 would then be pivoted through an arc and another line of dots would be printed using the same preselected heating elements 62. As best shown in FIG. 10, this process continues until the entire matrix of dots is printed to form the test symbol 12A. The test symbol 12A is printed darker than the background of document 14 on which it is printed so that it can be easily sensed by the sensor 64.

Figure 13:
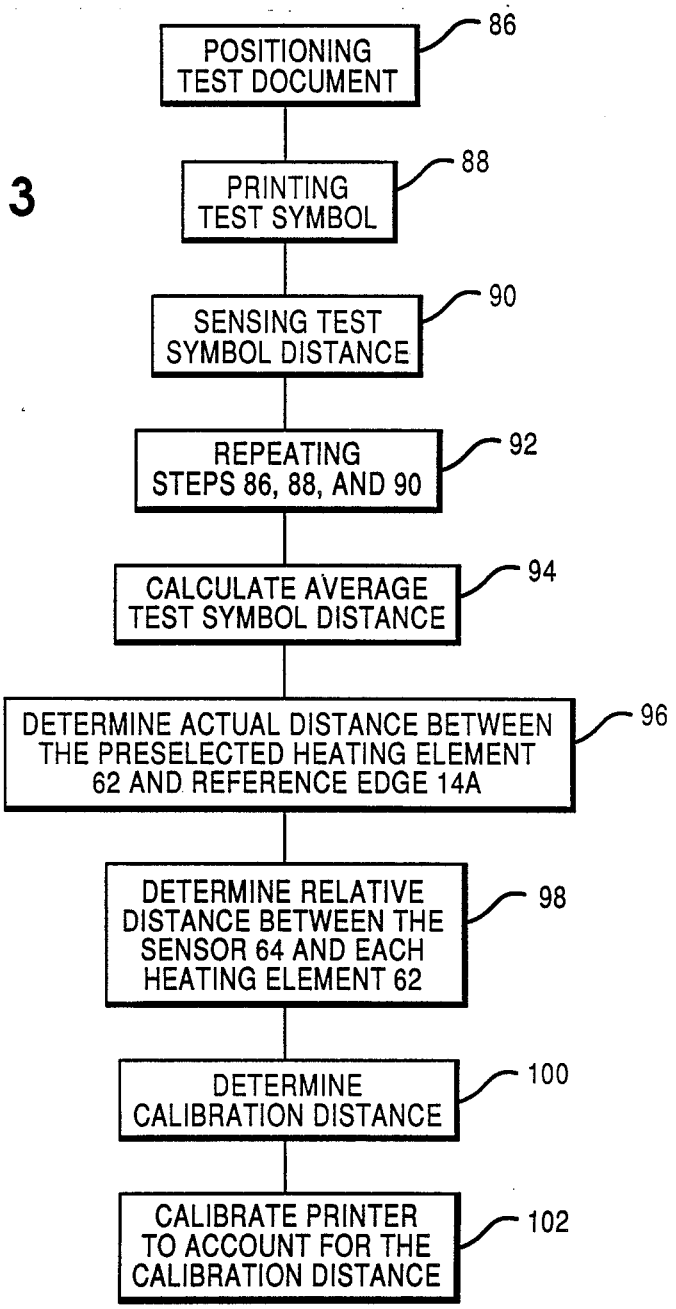
FIG. 13 is a general schematic view of a general method of calibrating the printer.

As shown by block 90 in FIG. 13, the next step in this method of calibration is to determine the distance between the sensor 64 and the center heating element 62 used to print the test symbol 12A in order to provide test symbol distance. After the test symbol 12A is printed on the test document 14, the test document 14 is removed from track 18, inverted (bottom to top and front to back), and reinserted into the track 18 upstream from sensor 64 so that test symbol 12A faces track wall 18A. The master controller 66 then energizes document stepping motor 22 to move the document 14 down the track 18 until the test symbol 12A passes the sensor 64. The document 14 is then reversed in the track 18 by document stepping motor 22 until the reference edge 14A is approximately 3 millimeters upstream from sensor 64. The document 14 is then incremented forward and the sensor 64, which is coupled to A/D converter 70 (FIGS. 2 and 9), begins taking measurement samples until well after the test symbol 12A has passed sensor 64. In a preferred embodiment, the sample rate of the A/D converter 70 is made equal to the pitch of the heating elements 62 of thermal printhead 56 which results in a sample rate of 8 samples per 0.050 inch step. As a result of this sampling, differing digital values corresponding to the time (FIG. 9A) when the sensor 64 senses, for example, no document (time 67A), the reference edge 14A (time 67B), and midpoint of the test symbol 12A (time 67E) are stored in the RAM 69. The master controller 66 includes software which computes the time required for the document 14 to travel, with reference to the sensor 64, between the reference edge 14A (time 67B) and the midpoint of the test symbol 12A

Figure 12:
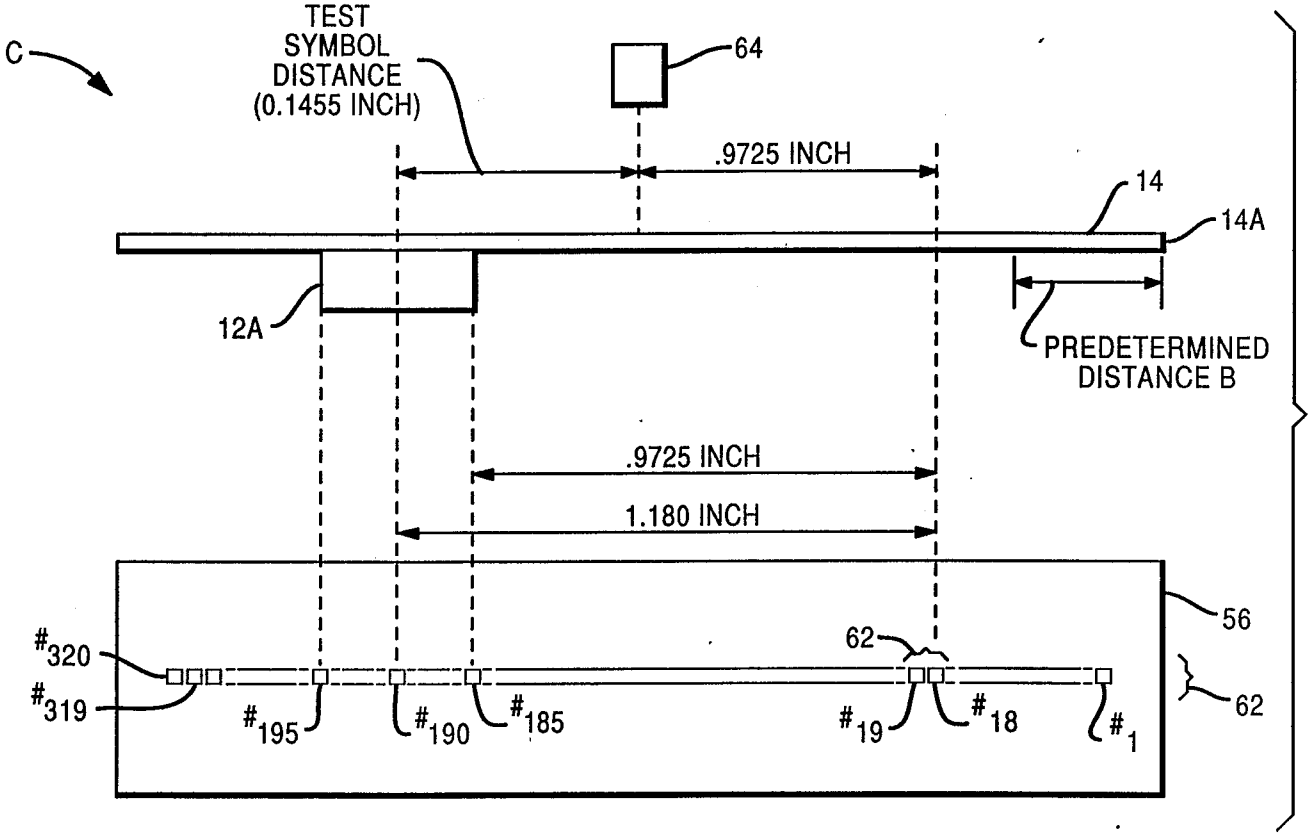
FIG. 12 is a top general diagrammatic view of the print station, showing an enlarged view of the print station and the general relationship among a sensor, the document, and the print member.

(time 67E). The software in the master controller 66 then determines the test symbol distance by utilizing the time difference between these two values (time 67B) and the midpoint of the test symbol 12A (time 67E) and by multiplying by the known step rate mentioned previously herein. This test symbol distance is best shown in relation to FIG. 12. As shown by block 92 in FIG. 13, this is repeated for a plurality of test documents 14. Another step, indicated by block 94 in FIG. 13, involves the master controller 66 calculating an average test symbol distance for all of the test documents 14. It is to be noted that the average test symbol distance represents the average distance between the reference edge 14A and the midpoint of the test symbol 12A for a plurality of test documents 14.

Another step, as indicated by block 96 in FIG. 13, is to determine the actual distance between the preselected heating element 62 and the reference edge 14A. Notice that the reference edge 14A (FIGS. 7 and 12) represents the location of the sensor 64, and the heating element 62 (#190) represents the midpoint heating element 62 when the test symbol 12 is printed on the document 14. The average test symbol distance also represents the average distance between sensor 64 and heating element 62 (#190). Using the document stepping motor 22 pitch distance mentioned above, the master controller 66 includes software which provides a means for determining the number of heating elements 62 corresponding to the average test symbol distance by dividing the average test symbol distance by the known pitch distance between heating elements 62. Another step (block 98 in FIG. 13) includes the master controller 66 using the average test symbol distance to determine the distance of each heating element 62, relative to the sensor 64, of the print member 56 using the fixed pitch distance (0.0065 inch) between each heating element 62. The master controller 66 stores the average test symbol distance and each locations of each heating element 62 as a binary number in EEPROM 68.

The next step (block 100 of FIG. 13) is to determine the calibration distance using the above information. The calibration distance is the distance that the printer 10 has to be calibrated in order to print data 12 at the specified distance B from the reference edge 14A of the document 14. The master controller 66 determines the calibration distance by comparing the specified distance B, which is stored in EEPROM 68, to the average test symbol distance mentioned above. As will be described in detail later herein, the calibration distance can be further adjusted, for example, to compensate for inaccuracies in stopping the reference edge 14A of document 14 at sensor 64. The calibration distance is stored in EEPROM 68.

The final step (block 102 in FIG. 13) is to calibrate the printer 10 to account for the calibration distance. The master controller 66 makes coarse calibration adjustments by adjusting the location of document 14 at the print station C by using the document stepping motor 22. The master controller 66 includes software which calculates the number of full or half steps which would be necessary to account for the calibration distance by dividing the calibration distance by the known full and half step distance of the document stepping motor 22. Master controller 66 energizes document stepping motor 22 in full and/or half steps to stop document 14 early or late at the print station C so that the heating element 62 selected to print the leading edge of the first character of data 12 on the document 14 will be properly aligned at the specified distance B from the reference edge 14A of document 14. The master controller 66 makes fine calibration adjustments by selectively energizing the heating elements 62 on print head 56. The master controller 66 includes software which provides means for enabling the master controller 66 to determine the exact heating elements 62 of print member 56 which can be energized to adjust for some or all of the excess calibration distance which was not adjusted for by using the document stepping motor 22. The software in the master controller 66 determines the number of heating elements 62 which are equivalent to the calibration distance by dividing the excess calibration distance, if any, by the known pitch distance between each heating element 62. Because the midpoint heating element 62 used to print the test symbol 12A is known, the software in the master controller 66 adds or subtracts the number of heating elements 62 determined above from the known location of the midpoint heating element 62 in order to account for the excess calibration distance. In a preferred embodiment, document stepping motor 22 is used to make coarse calibration adjustments to printer 10 to correct for calibration distances of 0.0250 or greater. The heating elements 62 of print member 56 are used to make fine calibration adjustments of between 0.0065 and 0.0250 inch. Calibration adjustments of less than 0.0065 inch are disregarded as acceptable error. The calibration of printer 10 will be described in detail later herein.

The following example illustrates the above method. Assume that the test symbol 12A was printed (block 88 in FIG. 13) using heating elements #185–#195 (FIGS. 7 and 12) on five test documents 14. Assume further that the actual five sample test symbol distances between sensor 64 and the midpoint of the test symbol 12A were determined (blocks 90 and 92 in FIG. 13) in the manner described earlier herein to be 0.145 inch, 0.153 inch, 0.134 inch, 0.138 inch, and 0.1575 inch. The master controller 66 would compute the average test symbol distance (block 94 in FIG. 13) between the sensor 64 and the midpoint of the test symbol 14A of 0.1455 inch. As mentioned previously herein, the master controller 66 would then determine the distance between the sensor 64 and the preselected heating elements (block 96 in FIG. 13). The master controller 66 would then calculate the relative distance between the sensor 64 and each heating element 62 (block 98 in FIG. 13) using the known pitch distance between each heating element 62 of 0.0065 inch. The master controller 66 stores this number in EEPROM 68 and uses this information to determine the calibration distance (block 100 in FIG. 13) and to calibrate the printer 10 (block 102 in FIG. 13) in the following manner. If it were desired that heating element 62 (#18) be used to print the leading edge of the first character of data 12, then the master controller 66 would determine the distance between heating element 62 (#190), which is the midpoint of the test symbol 12A, and heating element 62 (#18) to be used. In the present example, this distance would be 1.118 inches ($(190-18)\times 0.0065$ pitch distance). A calibration distance (block 100 in FIG. 13) between sensor 64 and heating element 62 (#18) can then be calculated as 0.9725 inch (1.1180–0.1455). As will be described later herein, the printer 10 will then be calibrated (block 102 in FIG. 13) to account for this distance so that when the document 14 is processed, the document 14 is advanced in track 18 so as to position the document so that heating element 62 (#18) is placed over the location of the document 14 where it is desired to effect the printing.

As mentioned previously herein, it may be desirable or even necessary to print the leading edge of the first character of data 12 at the specified distance B (FIGS. 4 and 12) from the reference edge 14A of document 14. Consequently, it may be necessary to add the specified distance B to the calibration distance determined in block 100 of FIG. 13 and described earlier herein. If it were desired that the leading edge of the first character of data 12 to be printed, for example, be located 5/16 inch or 0.3125 inch from the reference edge 14A of document 14, then in the example being described, the software in the master controller 66 would calculate the calibration distance of 1.2850 inches (0.9725+0.3125). The calibration process (block 102 in FIG. 13) is continued as follows.

As mentioned previously herein, the master controller 66 energizes the document stepper motor 22 in full steps of 0.050 inch or half steps of 0.025 inch to make coarse calibration adjustments of greater than 0.0250 inch. The document stepping motor 22 would advance the document 14 forward a total of 1.2750 inches (25 full motor steps or 1.250 inches and 1 half motor step or 0.0250 inch). This leaves an excess calibration distance of 0.010 inch (1.2850–1.2750). The master controller 66 selectively energizes one or more heating elements 62 on the print member 56 to make fine calibration adjustments of less than 0.0250 inch in the preferred embodiment. In this example, the software in the master controller 66 would divide the 0.010 inch excess calibration distance by the pitch distance of 0.0065 inch to determine obtain 1 (rounded) heating element 62 which represents the excess calibration distance. In the example being described, the master controller 66 software would add 1 heating element location to the heating beginning heating element 62 (#18) to account for most of the excess calibration distance. Thus, master controller 66 would energize heating element 62 (#19), rather than heating element 62 (#18) to account for the excess calibration distance. Excess calibration distances of less than the pitch distance (0.0065 inch) of the heating elements 62 are disregarded as accepted error, as mentioned previously herein. Consequently, the leftover calibration distance of 0.0035 inch is disregarded.

During normal processing of documents 14, like checks, further adjustments with respect to the calibration distance, referred to in block 100 of FIG. 13, may be necessary because of the inaccuracies arising from not accurately stopping the reference edge 14A at the sensor 64. A typical document 14 enters the print station C (FIGS. 2, 6, and 8) and is moved to the sensor 64 at which time it is stopped. Errors result from the reference edge 14A of document 14 not stopping at the exact instant that it is sensed by sensor 64. The master controller includes a timer 63 (FIG. 2) which is used to calibrate the printer 10 to account for these errors. The timer 63 provides an elapsed time count for each motor phase pulse (not shown) of the document stepping motor 22 at the start of each full step of the motor 22. At the instant the reference edge 14A of document 14 is detected by sensor 64, the master controller 66 immediately halts the timer 63. The elapsed time count on the timer represents both the amount of time that the document drive motor 22 remained energized and the distance the document 14 traveled past sensor 64 before the sensor 64 sensed the reference edge 14A. The additional calibration distance is determined by using the elapsed time count for the portion of the full step completed when the document 14 was stopped at sensor 64 as a percentage of the elapsed time count for a full step. For example, if the elapsed time count for a full step of document stepper motor 22 corresponds to 0.040 milliseconds and the elapsed time count measured when the document 14 was halted corresponds to 0.016 milliseconds, then it would be determined by master controller 66 that the document 14 traveled 40% (0.016 ms/0.040 ms) of a full step or 0.020 inch (0.050 full step distance×0.40) before the document 14 actually stopped at the sensor 64. Consequently, an additional calibration distance of 0.030 inch (0.0500–0.020) will result. If the printer 10 is not calibrated to account for this error, then the reference edge 14A of the document 14 would travel 0.030 inch farther than desired before the leading edge of the first character of data 12 is printed at the specified distance B (FIG. 4) from the reference edge 14A on the document 14. The master controller 66 can account for this 0.030 inch error by selectively energizing heating elements 62 in print member 56 which are closer to heating element 62 (#1), for example, or by energizing the document stepping motor 22, in the manner described previously herein.

It should be noted that the printer 10 can be calibrated using the above method to account for manufacturing tolerances which cause the print member 56 to be located at a distance from the sensor 64 which is different from the specified distance B. The manufacturing tolerances can arise from, for example, separate mounting of the print member 56 on the arm 46 and the sensor 64 onto the track 18. Because the dot size and pitch of the heating elements 62 used to print a character of data 12 on document 14 are known, the preferred embodiment of this invention also permits the stopping position of the document 14 at the print station C (FIGS. 2, 6, 8, and 10) and the selection of heating elements 62 to be varied so as to utilize different heating elements 62 in the printing of data 12 on document 14. Utilizing the invention in this way prolongs the useful life of the print member 62. Somewhat similar arrangements for selective energization of thermal printing elements are disclosed in U.S. Pat. No. 4,595,935 and U.S. Pat. No. 4,625,216, which are assigned to the assignee of the present application and which are incorporated herein by reference.

Figure 11:
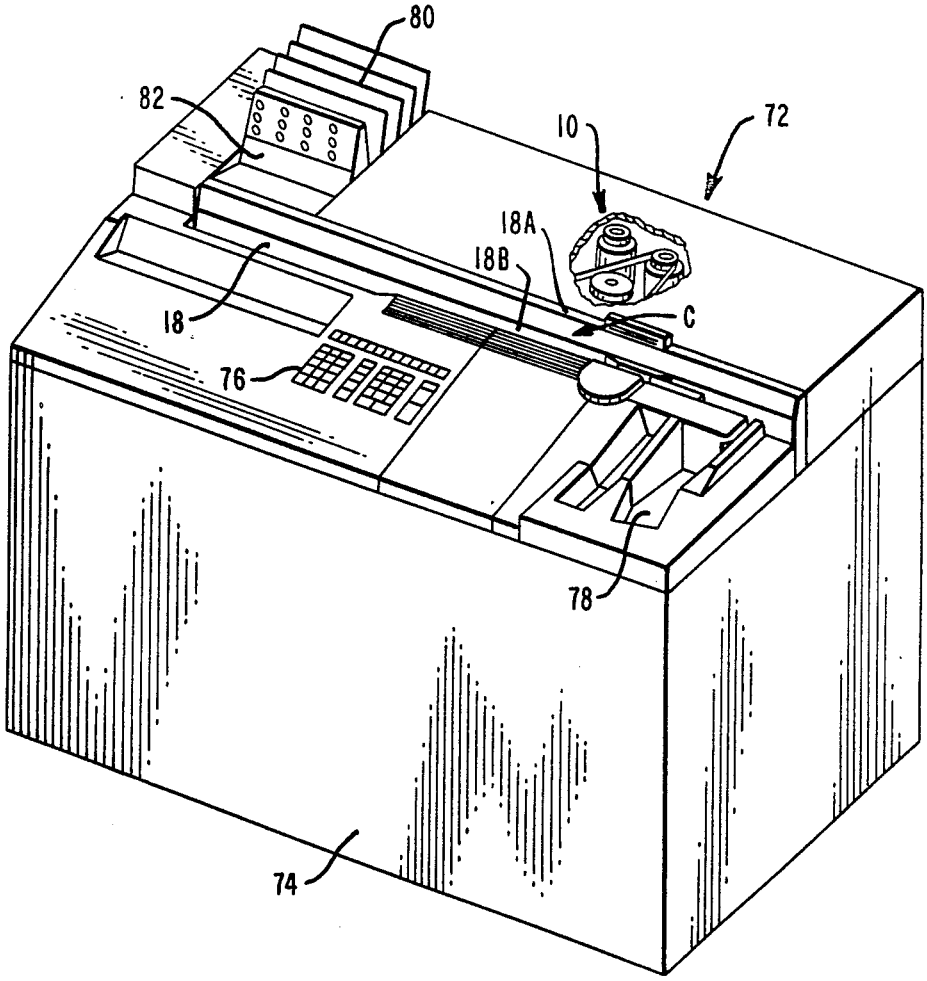
FIG. 11 is a general perspective view of a typical environment in which this invention may be used.

FIG. 11 shows a typical environment in which this invention might be used. One such environment includes a check endorser 72 having a housing 74 in which printer 10 is mounted by suitable fasteners (not shown). A plurality of checks 80 are stored in a check storage tray 82. As is shown, printer 10 is mounted downstream from check storage tray 82. Before documents are processed, printer 10 is calibrated using the method described above so that data 12 is printed at substantially the preselected area A on the documents 14. When it is desired to process checks 80, the checks can be transferred mechanically from the tray 82 to the document track 18 where they are then transported to the print station C at printer 10. A teller or bank employee can use keyboard 76 to cause data 12 to be printed on the checks 80. After the checks 80 are processed, they are moved downstream through track 18 to a check collector compartment 78 which collects the processed checks 80.

Various changes or modifications in the invention described may occur to those skilled in the art without departing from the spirit or scope of the invention. For example, in a preferred embodiment the calibration process mentioned above proceeds along a horizontal direction; however, the same process could be employed to calibrate a printer in a vertical direction to set the character height from a bottom edge of the document 14. The above description of the invention is intended to be illustrative and not limiting, and it is not intended that the invention be restricted thereto but that it be limited only by the true spirit and scope of the appended claims.

What is claimed is:

1. A method for calibrating a printer at a print station to print data in a character field beginning at a specified distance from the reference edge of a document moving through said print station; said method comprising the steps of:

(a) positioning a test document at the print station;

(b) printing a test symbol on said test document with a print member having a plurality of heating elements, said test symbol having a midpoint which is printed by a preselected heating element;

(c) sensing the test symbol distance between said reference edge and the midpoint of said test symbol with a sensor;

(d) repeating step (a) through step (c) at least one time;

(e) calculating an average test symbol distance by averaging the test symbol distances determined in steps (c) and (d);

(f) determining the actual distance between the preselected heating element and said reference edge;

(g) determining the relative location between said sensor and each said heating element of said print member;

(h) determining a calibration distance which is the difference between said actual distance determined in step (f) and said average test symbol distance; and (i) calibrating said printer to account for said calibration distance so that the leading edge of the first character of data to be printed is printed on each document at said specified distance from the reference edge of said document when said document is moved through the print station.

2. The method as recited in claim 1 wherein said step (a) is effected by the steps of:

(a1) moving said test document to said print station at a predetermined rate of speed;

(a2) sensing the reference edge of said test document; and (a3) stopping said test document when said step (a2) is effected.

3. The method as recited in claim 2 wherein said step (a) further includes the steps of:

(a4) backing said test document away from said print station;

(a5) moving said test document to said print station at a second rate of speed which is less than said predetermined rate of speed so as to more accurately determine the reference edge of the document; and (a6) repeating said step (a2) and step (a3).

4. The method as recited in claim 1 wherein said step (f) further includes the step of:

(f1) adjusting said calibration distance to account for an inaccurate determination of said reference edge.

5. The method as recited in claim 1 wherein said step (a) is effected by incrementing a stepping motor in full or half steps.

6. The method as recited in claim 1 wherein the printing of said step (b) is performed with a dot matrix thermal printer having at least one row of heating elements which are positioned in a line which is normal to said reference edge.

7. The method as recited in claim 4 wherein said step (c) further includes the step of:

(c2) inverting said document so that said test symbol is reversed in order to get a measurement of the actual distance between the reference edge of the document and the midpoint of said test symbol as printed in step (b).

8. The method as recited in claim 1 wherein said step (b) is effected by the step of:

(b1) selecting a first set of heating elements from said plurality of heating elements to print said test symbol on said test document.

9. The method as recited in claim 5 wherein said step (i) is effected by the step of:

(i1) utilizing said stepping motor to calibrate the printer to account for calibration distances greater than 0.025 inch.

10. The method as recited in claim 1 wherein said step (i) is effected by the step of:

(i1) utilizing at least one heating element of said print member to account for calibration distances between 0.0065 and 0.025 inch.

11. The method as recited in claim 9 wherein said step (i1) is further effected by the step of:

(i2) utilizing at least one heating element of said print member to account for calibration distances between 0.0065 and 0.025 inch.

12. The method as recited in claim 9 wherein said step (i1) is further effected by the step of:

computing the number of full and half steps of the document stepping motor which are needed to position the document so that the leading edge of the first character of data is printed at said specified distance from the reference edge of the document.

13. The method as recited in claim 10 wherein said step (i1) is further effected by the step of:

computing the exact heating element which must be energized to effect calibrating the printer after taking into account the specified distance.

14. A printer for printing data starting at a specified distance from a reference edge of a document, said printer comprising:

a print station;

a track for feeding a document to said print station;

a print member located at said print station;

drive means for moving a document towards and away from said print station;

said print member including a plurality of heating elements located at the print station, said print member being capable of printing data including a test symbol on said document;

sensing means for sensing the reference edge of said document; and control means for controlling said printer, said print member, said drive means, and said sensing means;

said control means being effective to:

energize preselected ones of said plurality of heating elements to print said test symbol on said document, said test symbol having a midpoint being printed with a preselected heating element;

energize said sensing means to sense an actual distance between said reference edge and said midpoint of said test symbol to provide a test symbol distance;

determine an average test symbol distance based upon the test symbol distances sensed for a plurality of said documents;

calculate a distance between said reference edge and said preselected heating element to provide a midpoint heating element distance;

use said midpoint heating element distance to determine the relative location of each heating element relative to said sensor;

calculate the difference between said midpoint heating element distance and said average test symbol distance to provide a calibration distance;

adjust said calibration distance to account for said specified distance; and calibrate the printer to account for the calibration distance;

said control means energizing said drive means and selectively energizing said heating elements in order to calibrate the printer to adjust for said calibration distance so that the printer will print data beginning at said specified distance from said reference edge of any said document moving through the printer.

15. The printer as recited in claim 14 wherein said drive means includes at least one stepping motor which can increment said document towards or away from said sensing means in full or half steps.

16. The printer as recited in claim 15 wherein the control means energizes the stepping motor to calibrate the printer to print data beginning at said specified distance.

17. The printer as recited in claim 15 wherein said heating elements of said thermal printer are selected to calibrate the printer so that the printer will print data beginning at said specified distance.

18. The printer as recited in claim 14 wherein said sensing means includes an optical sensor.

19. The printer as recited in claim 15 wherein said control means includes means for determining the number of said full or half steps which are necessary to calibrate the printer to account for calibration distances of greater than 0.025 inch.

20. The printer as recited in claim 14 wherein said control means includes means for enabling said control means to determine which heating elements of said print member to energize in order to effect calibrating the printer to account for calibration distances between 0.025 and 0.00650 inch.

21. The printer as recited in claim 19 wherein said control means includes means for enabling said control means to determine which heating elements of said print member to energize in order to effect calibrating the printer to account for calibration distances less than 0.0250 inch.

* * * * *